United States Patent [19]

Mayer

[11] 4,240,056

[45] Dec. 16, 1980

[54] MULTI-STAGE SOLENOID ACTUATOR FOR EXTENDED STROKE

[75] Inventor: Endre A. Mayer, Birmingham, Mich.

[73] Assignee: The Bendix Corporation, Southfield, Mich.

[21] Appl. No.: 71,915

[22] Filed: Sep. 4, 1979

[51] Int. Cl.[3] ..... H01F 7/08

[52] U.S. Cl. ..... 335/267; 335/268

[58] Field of Search ..... 335/251, 255, 259, 266, 335/267, 268

[56] References Cited

U.S. PATENT DOCUMENTS

| | | | |
|---|---|---|---|
| 3,017,546 | 1/1962 | Bates | 335/268 X |
| 3,488,614 | 1/1970 | Macy | 335/267 X |
| 3,491,319 | 1/1970 | Cox et al. | 335/268 X |

*Primary Examiner*—George Harris

*Attorney, Agent, or Firm*—Markell Seitzman; Russel C. Wells

[57] ABSTRACT

A solenoid actuator having a plurality of electromagnets mountably oriented within a housing. The actuator further includes an armature movably disposed within the housing having a like plurality of magnetically responsive members disposed at determinable distances from each electromagnet and wherein each magnetically responsive member is telescopically received one into the other.

9 Claims, 6 Drawing Figures

Fig-3
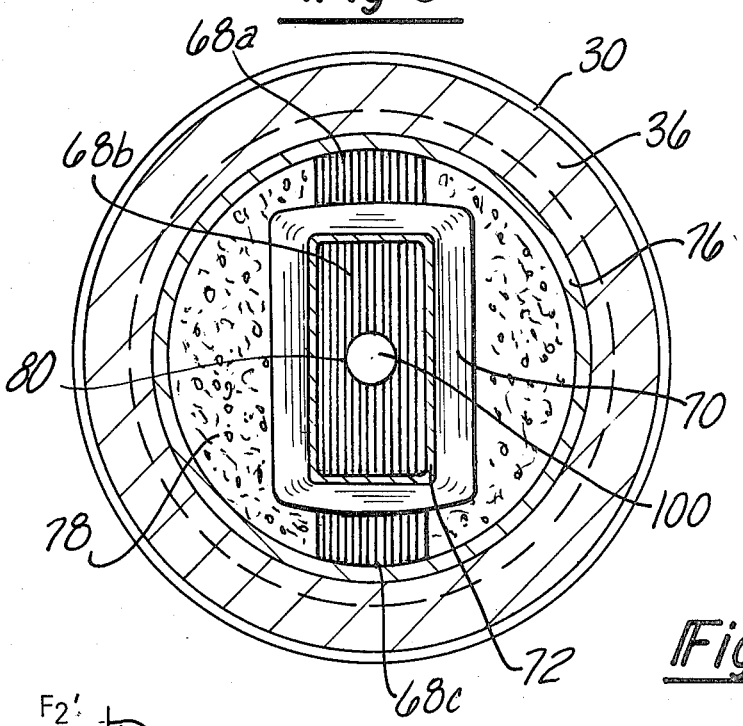
Fig-4
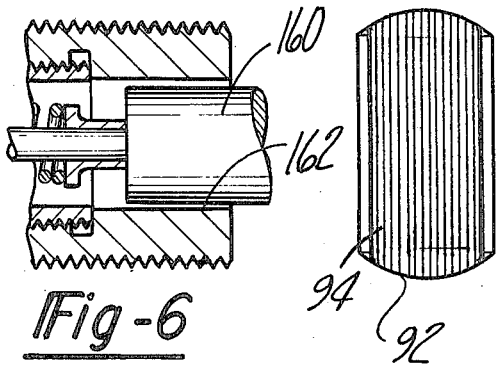
Fig-6
Fig-5
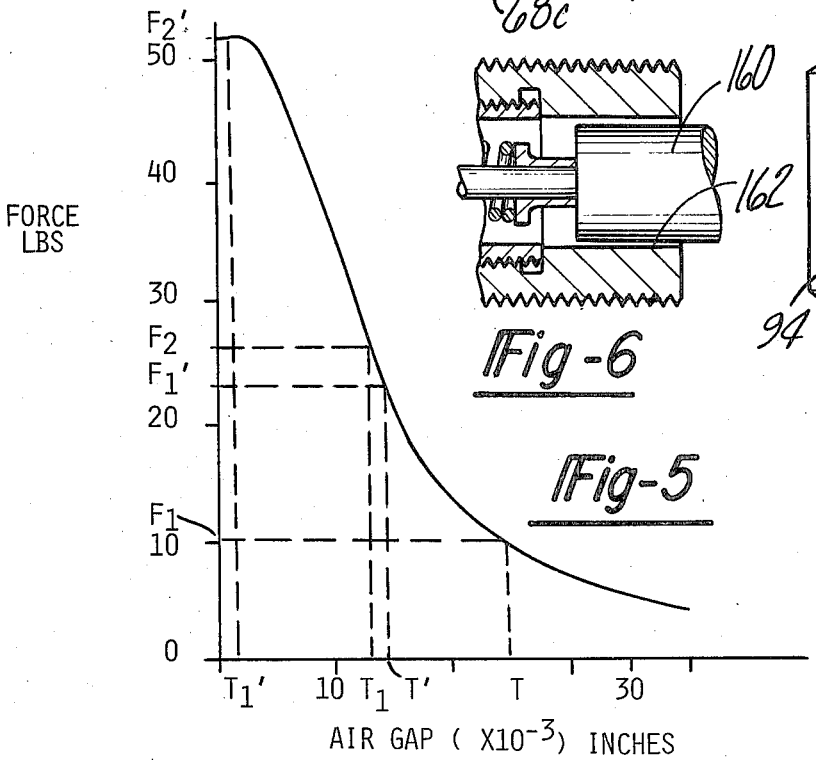

MULTI-STAGE SOLENOID ACTUATOR FOR EXTENDED STROKE

BACKGROUND

1. Field of the Invention

This invention relates to electromagnetic solenoid actuators having rapid response time and extended stroke. More particularly, the invention relates to actuators having multiple electromagnets for attracting a telescoping armature.

2. Prior Art

Solenoid actuators are known in the art. These actuators often comprise a movable armature maintained in a spaced relationship from an electromagnet. The distance therebetween, called an air gap, thereby defines the stroke of the armature. It is desirable to obtain a fast acting actuator having a long stroke. However, increasing the stroke implies a larger air gap which further implies developing a greater magnetic field to produce the requisite force to attract the movable armature. One method of developing these larger forces is to increase the size of the magnetic circuit; requiring a larger stator, coil and armature as well as requiring larger excitation currents. However, these larger units often take a greater time to build up or energize and de-energize the required magnetic field. Similarly, the response time of the armature is slowed because of its increased mass or inertia. It is not possible, however, to fully compensate for these longer response times merely by increasing the level of exciting current, and that the increased currents may only produce excessive local heating and power usage.

SUMMARY OF THE INVENTION

The present invention relates to an electromagnetic solenoid responsive to electric commands signals. The solenoid may be used as an actuating device to move an associated member into or away from itself or, as a valving device to controllably open and close a passage therein permitting fluid to flow therethrough.

The solenoid comprises a housing having a plurality of suitably placed electromagnets and a multi-piece armature movably situated within the housing and spaced with respect to the plurality of electromagnets. These electromagnets are located so that, when actuated by a control signal, they will tend to move the armature pieces in the same cooperative direction. The armature comprises a plurality of magnetically attractable members, one member associated with each electromagnet. Each of these magnetically attractable members are telescopically situated, one relative to the other, to permit a sliding motion therebetween. In addition, at least one of the electromagnets contains a centrally located passage to permit the sliding motion of an associated magnetically attractable member therethrough. Each of the magnetically attractable members is maintained, in the absence of electric commands, in a biased condition apart from its associated electromagnet. As an example if the armature has two magnetically attractable members, the second member is maintained at a smaller distance from its associated electromagnet than is the first member from its associated electromagnet. This relationship permits large electromagnetic forces to be exerted on the closer member. This force is sufficiently large to move the entire armature toward the electromagnets, thereby reducing the air gap or the spacing between associated with the closer member.

As the armature approaches the electromagnets, the force exerted on the farther situated magnetically attractable member increases dramatically to a level sufficient to continue to pull the initially farther-situated member toward its respective electromagnet. The telescopic mounting relationship permits the closer member to move the farther situated member and permits the farther-situated member to over-travel the closer member after the motion of the closer member has been stopped by its associated electromagnet.

The armature is connected to a valve or a piston which can be an integral part of the armature or can be an associated part of a co-acting device moved by the armature. When the electric actuation signals are removed, the armature returns to a biased position spaced apart from the respective electromagnets.

The preferred embodiment employs two laminated E-type electromagnets. Each pieces of the armature has a substantially rectangular frontal area, to conform to the substantially rectangular E-type electromagnet. It should be noted that other electromagnets, and armature designs may be substituted such as a cylindrical electromagnet and a corresponding circular armature.

A solenoid valve embodying the teaching of the present inventor is shown in FIG. 2 wherein the control of fluid flow from port 150 through aperture 38 and out through opening 134 is controlled by the movement of the armature 90. An alternate embodiment is shown in FIG. 6 which illustrates an actuating device incorporating the teachings of the present invention. More particularly, threaded bolt 140 of FIG. 2 has been replaced by threaded slide 160 which may represent the moveable portion of a nearby apparatus such as the spool of a spool valve which is activated by the movement of the armature 90. In addition, the threaded end cap 48 has been enlarged to accomodate the mass of the slide and a central bore 162 added to support and guide the slide 160.

An advantage of the present invention is that the multi-piece armature permits extended piston motion, while not requiring excessively large electromagnets or coils. A further advantage of the present invention is that the electromagnets can be independently actuated or alternatively can be connected in series or parallel wherein both electromagnets will simultaneously develop their magnetic fields.

A further advantage results from the reduced armature mass and increased actuating force permitting the rapid overcoming of static friction and rapid response.

It is an object of the present invention to provide a solenoid having rapid response and extended stroke. Many other objects and advantages of the present invention will be clear from the detailed description of the drawings.

A BRIEF DESCRIPTION OF THE DRAWINGS

In the drawings:

FIG. 3 is a sectional view taken through section 3—3 of FIG. 2 illustrating the E-shaped electromagnet; and FIG. 4 is a frontal view illustrating a portion of the armature;

FIG. 5 illustrates a graph of electromagnetic force between an electromagnet and a spaced armature as a function of the air gap for a fixed value of exciting current.

FIG. 6 illustrates a partial view of an alternate embodiment of the present invention.

DETAILED DESCRIPTION OF THE DRAWINGS

Figures 1, 2:
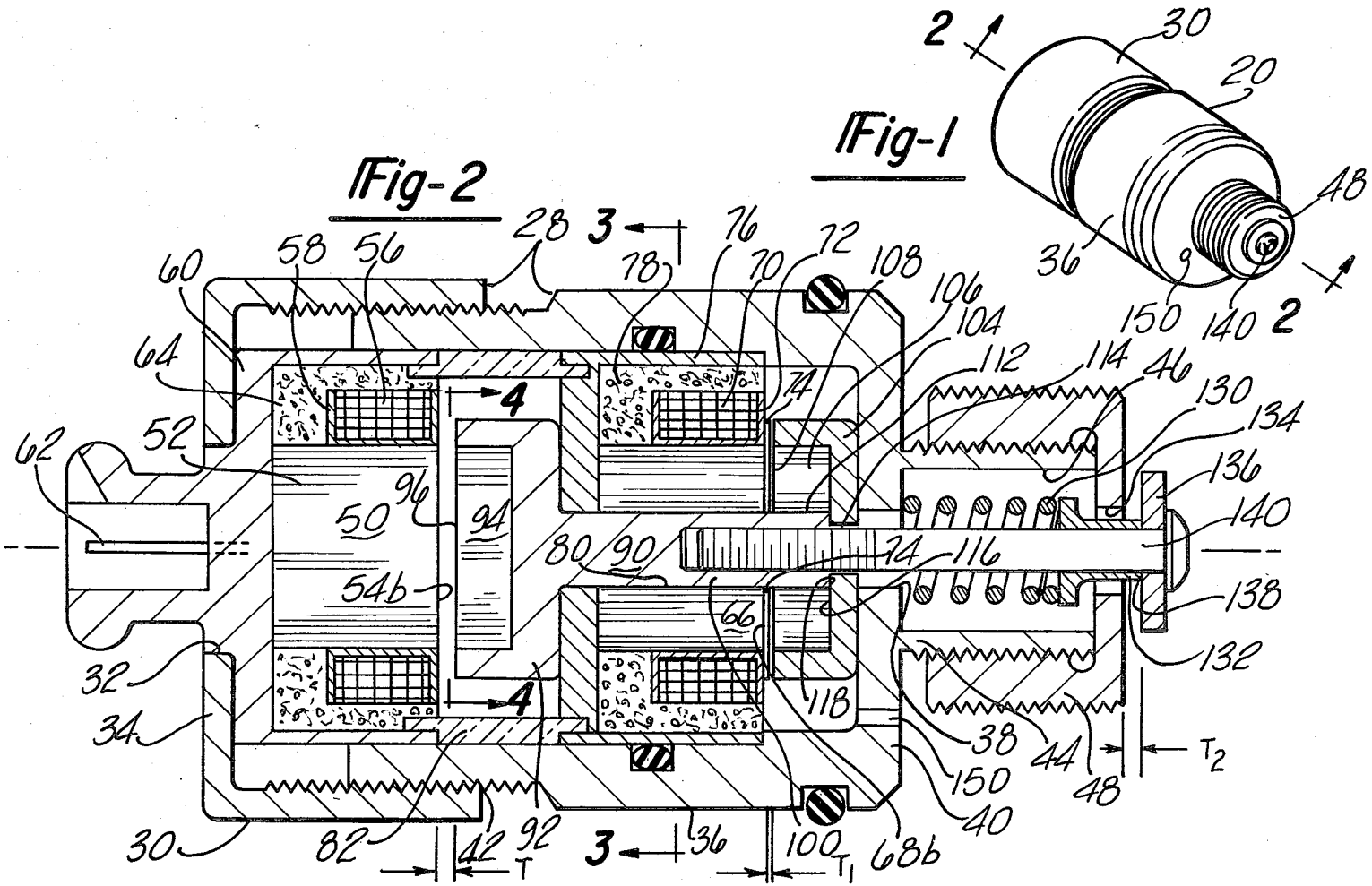
FIG. 1 is a perspective view of a valve incorporating the teachings of the present invention.
FIG. 2 is a sectional view taken through section 2—2 of FIG. 1.

Reference is made to FIG. 1 which illustrates a perspective view of the present invention; in particular, a valve apparatus incorporating the teachings of the dual solenoid 20. FIG. 2 is a sectional view through section 2—2 of FIG. 1 illustrating the interrelationship of the primary components of the present invention. The solenoid 20 comprises a multi-portion housing 28 including a first cup-like member 30, having a centrally located aperture 32 within its bottom 34. The housing 28 further includes a second cup-like member 36 having a bottom 40 with a centrally located aperture 38. The first member 30 and second member 36 are threadedly engaged one to the other by screw threads 42.

The solenoid 20 further includes an electromagnetic assembly 50 which comprises a first electromagnet 52 having a plurality of pole faces 54 and a coil 56 wound around a suitably sized bobbin 58. The relationship between the bobbin 58 and coil 56 is also shown in FIG. 3. In the preferred embodiment of the invention, the electromagnet 52 is an E-type electromagnet having three pole faces 54 (only the center pole face 54*b* is shown) and adapted to securely fit within a cup-like holder 60. The cup-like holder 60 is further adapted to receive electrical commands input thereto through an electrical connector such as connector 62, which is adapted to communicate with the first electromagnet 52 and the soon to be described second electromagnet 66. The electromagnet 52, coil 56 and bobbin 58 are secured within the cup-like holder 60 by a sealant such as potting compound 64. The holder 60 is received within member 30 and protrudes from aperture 32. The electromagnetic assembly 50 further includes a second electromagnet 66 having a plurality of pole faces 68 and a coil 70 wound about a bobbin 72. The second electromagnet 66 is preferrably another E-type electromagnet.

The second electromagnet 66, coil 70 and bobbin 72 are secured within a cup-like holder 76 by potting compound 78. The cup-like holder 76 further includes a feed-through (not shown) for feeding the ends of the wire of coil 70 to the connector 62. Depending upon the control philosophy employed to operate the actuator 20, the coils 56 and 70 can be operated independently, in parallel or connected in series.

Both electromagnets 52 and 66 are preferably constructed using a laminated core fabricated from one of the known varieties of high silicon oriented magnetic steels. While the prefered embodiment utilizes an E-type electromagnet, other electromagnet shapes may be substituted without departing from the spirit of the invention. The E-shape of the electromagnets naturally follows from the fact that the high silicon oriented magnetic laminates are often available as flat stock. Both cup-like holders 60 and 76, respectively, are preferably fabricated from non-magnetic materials such as plastic or aluminum.

As can be seen from FIG. 3, the center leg, and pole face 68*b*, contains a centrally located passage 80 sized to slidably receive a portion of the armature. It should be noted that the electromagnet 66 is fitted with a non-magnetic spacer 74 which limits the minimum air gap between pole faces 68*a–c* and a co-acting portion of the armature. The non-magnetic spacer 74 is not a requirement of the invention, though it is a desirable feature, as one skilled in the art can appreciate. The non-magnetic spacer 74 limits the maximum developed magnetic force between the electromagnet 66 and armature 90, as well as protects the relatively soft laminates from becoming damaged.

Reference is again made to the electromagnetic assembly 50 of FIG. 2. This assembly further comprises a non-magnetic cylindrical sleeve 82 which fits within splines or grooves in each cup-like holder 60 and 76, respectively. The cylindrical sleeve 82 permits the proper spacing between the first electromagnet 52 and the second electromagnet 66 to be achieved upon assembly.

The solenoid 20 further comprises a multi-piece armature 90, including a non-magnetic inner member 92, which is telescopically received within an outer member 104. The inner member 92 has a magnetic pole piece 94 inserted therein having pole face 96. The inner member 92 also has a tubular portion 100 extending therefrom. The outer member 104, similarly contains a magnetic pole piece 106 with a corresponding pole face 108. The pole piece 106 is received within the outer member 104 which is preferably a non-magnetic structure. Recalling that the preferred embodiment utilizes an E-shaped electromagnetic, both members 92 and 104 and the magnetic pole pieces 94 and 106 are substantially rectangular members comporting to the generally rectangular shape of the E-type electromagnets. In addition, the magnetic pole piece 106 further includes a centrally located passage 112, which is substantially the same size as passage 80. The outer member 104 further includes an aperture 114 which is smaller than, but coaxial to, passage 112. The difference in the dimensions between passage 112 and aperture 114 provides a shoulder 116 to engage the end 118 of the tubular portion of the inner member 92.

FIG. 4 illustrates the generally rectangular shape of the pole face of each pole pieces, in particular the inner pole piece 92 which comports to the generally rectangular shape of the E-type electromagnets.

These relationships permit the tubular portion 100 to be slidably positioned within passage 80 and telescopically received within passage 112. These relationships also permit the shoulder 116 to engage the tubular portion 100 to move the inner member 92 toward its respective electromagnet 52, while permitting the inner member 92 to overtravel relative to the outer member 104 after the outer member 104 has come in contact with and has been stopped by the electromagnet 66 or the non-magnetic spacer 74.

The solenoid 20 further includes a helical spring 130 located within a bore 46 of a tubular extension 44 of the housing 28. One end of spring 130 abuts the housing while its other end engages a hollow piston 132 which is slidably received within an opening 134 of the threaded end cap 48. A valve seat 136 is secured to the end 138 of the piston extending from cap 48. The valve seat 136, piston 132 and spring 130 are secured within the housing by a threaded bolt 140. Threaded bolt 140 extends through aperture 38 of the second member 36, through aperture 114 of the outer pole piece and is threadedly received within the tubular portion 100 of the inner member 92. In this manner, the helical spring 130 exerts an outward force on the piston 132 and threaded screw 140, therein biasing the inner member 92 into the shoulder 116 of the outer member 104, which in turn biases the outer member 104 against the bottom 40 of the second member 36 of the housing 28.

If the present invention is to be utilized as part of a valved apparatus, a port 150 may be provided in member 36 as shown in FIG. 2 to permit fluid under pressure to flow therethrough and into bore 46 or vice versa. The fluid within bore 46 will be permitted to flow out through opening 134 in correspondence with the position of the valve seat 138 with respect to the end cap 48.

It should be apparent from FIG. 2 that the valve seat 136 or screw 140 can be part of the coacting apparatus so activated by the actuator 20.

Those familiar with the art will appreciate that the extended stroke feature of solenoid 20 can be used to actuate a nearby sliding member of a 3-way valve or a spool of a spool valve which may be part of a fuel injector for an automotive engine. Reference is made to FIG. 6 which illustrates an alternate embodiment of the present invention. More particularly, threaded bolt 140 of FIG. 2 has been replaced by a threaded slide 160 which may represent the moveable member of the coacting apparatus actuated. In addition, the end cap 48 has been enlarged to accommodate the mass of the slide 160 having a central bore 162 to protect and guide the reciprocating slide 160.

The following discussion is directed to a description of the operation of the solenoid 20. FIG. 2 illustrates the solenoid 20 in its deactivated or unenergized state wherein the spring 130 biases both armature portions, (members 92 and 104) one into the other, and further biases the outer member 104 into the bottom 40 of the second member 36 of the housing. In this biased position the pole face 96 of the inner member 92 is maintained at a distance T from electromagnet 52. The pole face 108 of the outer member 104 is maintained at a lesser distance $T_1$ from the second electromagnet 66. In addition, the valve seat 136 is maintained at a distance $T_2$ from the end cap 48.

A controller (not shown) will, upon demand, energize the electromagnet assembly 50 with a predetermined electric current, thereby producing a determinable electromagnetic force between the electromagnetic assembly 50 and the armature 90. It is preferable that the electromagnet, such as electromagnet 66 which is associated with the smaller spacing $T_2$, be energized first, or at least concurrently, with electromagnet 52. The reasons for this will become apparent from the following discussion.

It can be seen from FIG. 5 that as the air gap, i.e., the distance T or $T_1$ increases the available electromagnetic attractive force significantly, and rapidly decreases so that at distances in excess of 0.04 inches, the force available for actuation of each armature portion 92 and 104 is less than 5 lbs. Consequently, if the stroke of the actuator is to be larger than 0.04 inches, it would have been required in prior art solenoids, to attract the armature 90 to increase the exciting current to the electromagnetic assembly 50 (which increases the power requirements of the solenoid 20) or to enlarge the dimensions of the electromagnets 52 and 66 and the size of the armature pole pieces 94 and 106 thereby increasing actuator size and weight which further reduces the response time.

As an example, using the present solenoid 20, assume that the inner member 92 is disposed within the housing 28 in the deactivated state at a distance T from the first electromagnet 52, and further assume that the outer member 104 (which receives the tubular portion 100 of the inner member) is disposed at a distance $T_1=T/2$ from the second electromagnet 66. Further assume that both electromagnets 52 and 66 are energized simultaneously. Upon energization a magnetic force $F_2$ will be exerted on the outer member 104 and a substantially smaller magnetic force $F_1$ will be exerted by electromagnet 52 on the inner member 92. The reason for this difference in magnetic forces, can be accounted for by the fact that the outer member 104 is disposed relative to its associated electromagnet 66 at a much smaller distance than is the inner pole piece 92 from its associated electromagnet 52.

The magnitude of the force $F_2$ is sized to be sufficiently large to cause the entire armature 90 (inner member 92 and outer member 104) to move toward the electromagnets. As the outer member 104 moves toward electromagnet 66, it engages and carries with it the inner member 92, thereby moving the piston 132 and the associated valve 136 or co-acting apparatus from their respective biased positions closer to the housing 28. The outer member 104 will continue to move to the electromagnet 66 until it contacts the spacer at a distance $T_1'$. At this moment the respective gap between the inner member and electromagnet 52 has been reduced to $T^1$. Consequently, by virtue of this smaller spacing, the magnetic force acting upon the inner member 92 $F_1'$ is sufficiently large to permit the inner member 92 to overcome the spring bias force and continue to move to the electromagnet 52 after the outer member as been stopped by the spacer 74.

It may be desirable, however, to incorporate an additional non-magnetic spacer (not shown) on the electromagnet 52 to limit the maximum magnetic forces (developed at or about a zero dimension air gap) and to protect the soft laminates of the electromagnet 52 and the magnetic pole piece 94 from damage.

Alternatively, the minimum air gap between the inner member 92 and the electromagnet 52 can be controlled by specifying the distance between the valve 136 and the end cap 48; more particularly, the distance $T_2$, such that the valve 136 bottoms against the end cap 48 when the inner pole piece 92 is at a determinable distance from its associated electromagnet 52.

The motion of the piston and/or associated apparatus in response to an actuation command is a multistep process comprising a first segment wherein the piston 132 is moved by the outer member 104 and a second segment characterized by increased magnetic forces acting upon the inner member 92 permitting it (and the piston 132) to over-travel relative to the outer member 104 and to continue to move into the housing 28. Selecting the air gap $T_1$ to be smaller than the air gap T, permits large starting forces to be developed. This feature is a practical advantage in mechanical systems where the initial break-out fricton at zero load (or armature) velocity is significantly larger than the operating force required after motion of the valve 136 (or spool) has started.

It should be apparent that the present invention is not limited to only two solenoids, in fact, a greater plurality of electromagnets and armature pieces can be incorporated to yeild actuators having extended stroke and rapid response. In addition, with minor modifications, the present invention can be used as a device which, rather than attracting a valve or piston into the housing, pushes the valve or piston away from the housing. One method of so modifying the present invention is to provide the center leg 54*b* of the electromagnet 52 with a passageway which is sized to receive a non-magnetic member which extends beyond the housing and is secured into a portion of the inner member 92.

Many changes and modifications in the above-described embodiments of the present invention can, of course, be carried out without departing from the scope thereof. Accordingly, that scope is intended to be limited only by the scope of the appended claims.

What is claimed is:

1. An apparatus comprising:

a housing defining a chamber therein and including a wall having at least a first opening there-through;

a first electromagnet located within said chamber opposite said first opening for producing a first magnetic field in response to electric command signals input thereto;

a second electromagnet having a passage therein, and located within said chamber between and apart from said first electromagnet and said wall for producing a second magnetic field in response to electric command signals input thereto;

an armature comprising:

a first member having a first pole face opposingly situated relative to said first electromagnet and responsive to said first magnetic field and maintained in the absence of command signals a first distance from said first electromagnet and having a portion extending opposite from said first pole face slidably received within and extending through said passage, a second member located within said chamber between said second electromagnet and said wall having a second pole face thereon opposing situated relative to said second electromagnet and responsive to said second magnetic field wherein said second pole face is maintained in the absence of command signals, a second distance apart from said second electromagnet, said second member further including a second passage sized to telescopically receive said portion and a narrower coaxial third passage extending therethrough, said second member further including a shoulder joining said second and said third passages for engaging said extending portion, a piston means slidably received through said third passage and operatively connected to said portion for biasing said portion against said shoulder to space said first and said second pole faces apart from said first and said second electromagnets.

2. The apparatus as recited in claim 1 wherein said piston means includes:

a piston slidably received through said third passage and operatively connected to said portion, and a spring means operatively attached to said piston for biasing said portion against said shoulder.

3. The apparatus as recited in claim 2 wherein said housing includes port means for communicating fluid into said housing and where said piston means further includes valve means for permitting flow through said housing and through said first opening in correspondence with the motion of said piston.

4. An apparatus as recited in claims 1 or 3 wherein said second distance is less than said first distance.

5. An apparatus comprising:

a housing defining a chamber therein and including a wall having at least a first opening there-through;

a magnetically responsive armature assembly;

a first electromagnet located within said chamber opposite said first opening for producing a first magnetic field in response to electric command signals input thereto;

a second electromagnet having first receiving means for receiving a portion of said armature assembly and located within said chamber between and apart from said first electromagnet and said wall for producing a second magnetic field in response to electric command signals input thereto and for moving said armature assembly in response to said second magnetic field;

said armature comprising:

a first member having a first pole face opposingly situated relative to said first electromagnet and responsive to said first magnetic field and maintained in the absence of command signals a first distance from said first electromagnet and having a portion extending opposite from said first pole face that is slidably received within and extending through said first receiving means, a second member having a second pole face thereon opposing situated relative to said second electromagnet and located within said chamber between said second electromagnet and said wall, wherein said second pole face is maintained in the absence of command signals, a second distance apart from said electromagnet, said second member further including displacement means for contacting and moving said first member to reduce said first distance in response to the magnetic field of said second electromagnetic and for permitting said extending portion to slidably move within said displacement means;

piston means slidably received through said opening and operatively connected to said extending portion for biasing said extending portion within said displacement means.

6. The apparatus as recited in claim 5 wherein said piston means includes:

a piston slidably received through said displacement means and operatively connected to said extending portion, and a spring means operatively attached to said piston for biasing said first member into said second member.

7. An apparatus comprising:

a housing defining a chamber therein and including a wall having at least a first opening therethrough;

a magnetically responsive armature assembly;

a plurality of electromagnets including:

a first electromagnet located within said chamber opposite said first opening for producing a first magnet field in response to electric command signals input thereto;

a second electromagnet having first receiving means for receiving a portion of said armature assembly therein and located within said chamber between and apart from said first electromagnet and said wall for producing a second magnetic field in response to electric command signals input thereto;

said armature comprising:

a plurality of magnetically attractive pole pieces including a first member having a first pole face opposing situated relative to said first electromagnet and responsive to said first magnetic field and maintained in the absence of command signals a first distance from said first electromagnet and having an extending portion operatively extending opposite from said first pole face and slidably received within and extending through said first receiving means, a second member having a second pole face thereon oppositely situated relative to said second electromagnet and located within said chamber between said second electromagnet and said wall, wherein said second pole face is maintained in the absence of command signals, a second distance apart from said second electromagnet, said second member further including means for contacting and moving said first member to reduce said first distance in response to the magnetic field of said second electromagnet and for permitting said extending portion to slidably move therein;

piston means slidably received through said opening and operatively connected to said extending portion for biasing said extending portion against said means for contacting.

8. The apparatus as recited in claim 6 wherein said housing includes port means for communicating fluid into said housing and through said first opening and where said piston means includes valve means for permitting flow through said first opening in correspondence with the position of said piston.

9. The apparatus as recited in claim 8 wherein said housing includes port means for communicating fluid to said first opening and where said piston means includes valve means for permitting flow through said opening in correspondence with the motion of said piston;

* * * * *